US011193268B2

(12) United States Patent
Sasanecki

(10) Patent No.: US 11,193,268 B2
(45) Date of Patent: Dec. 7, 2021

(54) JOIST HANGER

(71) Applicant: John Sasanecki, Tallmadge, OH (US)

(72) Inventor: John Sasanecki, Tallmadge, OH (US)

(73) Assignee: SHARK PRODUCTS LLC, Akron, OH (US)

( * ) Notice: Subject to any disclaimer, the term of this patent is extended or adjusted under 35 U.S.C. 154(b) by 0 days.

(21) Appl. No.: 13/621,515

(22) Filed: Sep. 17, 2012

(65) Prior Publication Data

US 2013/0067850 A1 Mar. 21, 2013

Related U.S. Application Data

(60) Provisional application No. 61/536,752, filed on Sep. 20, 2011.

(51) Int. Cl.
*E04B 1/38* (2006.01)
*E04B 1/26* (2006.01)

(52) U.S. Cl.
CPC ..... *E04B 1/2612* (2013.01)

(58) Field of Classification Search
CPC ..... E04B 1/2612; E04B 2001/2652; E04B 2001/266; E04B 1/2608; E04B 2002/7475; E04B 2002/7477
USPC ..... 52/289, 699, 702, 712, 715; 403/232.1
See application file for complete search history.

(56) References Cited

U.S. PATENT DOCUMENTS 478,163 A * 7/1892 Lehman ..... F16B 7/0446 403/190
1,406,723 A 2/1922 Caldwell
2,216,271 A * 10/1940 Joiner ..... E04D 1/34 52/548
3,036,347 A 5/1962 Findleton
3,147,484 A 9/1964 Nelson
3,345,029 A 10/1967 Palmer
3,365,222 A * 1/1968 Polyak ..... E04B 1/2608 403/384
3,601,428 A * 8/1971 Gilb ..... 403/232.1
3,703,304 A * 11/1972 Losee ..... F16B 15/0046 403/232.1
3,752,512 A 8/1973 Gilb
4,291,996 A 9/1981 Gilb
4,330,971 A * 5/1982 Auberger ..... 52/210
(Continued)

OTHER PUBLICATIONS

Simpson Strong-Tie Company Inc. online catalog (http://www.strongtie.com/products/connectors/LUC-LU-U-HU-HUC.asp), date published unknown, printed Sep. 15, 2011.
(Continued)

*Primary Examiner* — Brian E Glessner
*Assistant Examiner* — James J Buckle, Jr.
(74) *Attorney, Agent, or Firm* — Buckingham Doolittle Burroughs; Timothy A. Hodgkiss

(57) ABSTRACT

A joist hanger typically includes one or more teeth which can be manually pressed into a header to hold the joist hanger in place on the header to free up a worker's hands so that a worker can nail the joist hanger to the header without having to manually hold the joist hanger in place while driving the nails. The joist hanger may also include a height-setting tab configured to engage the bottom of the header to set the height of the joist hanger relative to the header. The tab may be a break-off tab to allow the joist hanger to be used without the tab if desired.

18 Claims, 14 Drawing Sheets

(56) References Cited

U.S. PATENT DOCUMENTS

| | | | | |
|---|---|---|---|---|
| 4,480,941 | A | 11/1984 | Gilb et al. | |
| 4,841,690 | A * | 6/1989 | Commins | 52/105 |
| 5,054,755 | A * | 10/1991 | Hawkes | 269/3 |
| 5,071,280 | A * | 12/1991 | Turner | 403/232.1 |
| 5,111,632 | A * | 5/1992 | Turner | 52/702 |
| 5,160,211 | A | 11/1992 | Gilb | |
| 5,240,342 | A * | 8/1993 | Kresa, Jr. | 403/232.1 |
| 5,419,649 | A | 5/1995 | Gilb | |
| 5,564,248 | A * | 10/1996 | Callies | E04B 1/2612 403/232.1 |
| 5,603,580 | A | 2/1997 | Leek et al. | |
| 5,778,625 | A * | 7/1998 | Druffel et al. | 52/577 |
| 6,079,176 | A * | 6/2000 | Westra et al. | 52/404.2 |
| 6,123,745 | A * | 9/2000 | Hess et al. | 52/677 |
| 6,463,711 | B1 * | 10/2002 | Callies | F16B 9/058 52/702 |
| 6,523,321 | B1 | 2/2003 | Leek et al. | |
| 6,607,086 | B1 * | 8/2003 | Gretz | E04B 9/006 211/123 |
| 6,725,619 | B1 * | 4/2004 | Barber | E04B 2/7457 52/100 |
| 7,225,590 | B1 * | 6/2007 | diGirolamo | E04B 1/4178 52/379 |
| 7,334,372 | B2 | 2/2008 | Evans et al. | |
| 7,343,712 | B2 * | 3/2008 | Shelton | 52/126.1 |
| 7,448,178 | B2 * | 11/2008 | Visone | E04B 1/2612 428/582 |
| 7,748,187 | B2 * | 7/2010 | Sensenig | E04F 15/02 52/489.1 |
| 7,971,409 | B2 * | 7/2011 | Bak et al. | 52/696 |
| 8,281,548 | B1 * | 10/2012 | Garcia | E04D 13/172 248/302 |
| 8,387,333 | B2 * | 3/2013 | Brekke | 52/702 |
| 10,494,819 | B1 * | 12/2019 | Murphy | E04F 13/0801 |
| 2004/0244328 | A1 * | 12/2004 | Bak et al. | 52/712 |
| 2006/0191233 | A1 * | 8/2006 | Tamlyn | 52/702 |
| 2008/0101855 | A1 * | 5/2008 | Lin | 403/232.1 |
| 2008/0163568 | A1 * | 7/2008 | Shelton | 52/126.1 |
| 2009/0113839 | A1 * | 5/2009 | Carr | 52/712 |
| 2012/0222382 | A1 * | 9/2012 | Brekke | 52/702 |
| 2012/0297724 | A1 * | 11/2012 | Pope et al. | 52/702 |

OTHER PUBLICATIONS

Simpson Strong-Tie Company Inc. online catalog (http://www.strongtie.com/products/connectors/RR.asp), date published unknown, printed Sep. 15, 2011.

Simpson Strong-Tie Company Inc. online catalog (http://www.strongtie.com/products/connectors/PF.asp), date published unknown, printed Sep. 15, 2011.

Simpson Strong-Tie Company Inc. online catalog (http://www.strongtie.com/products/connectors/SUR-SUL-HSUR-HSUL.asp), date published unknown, printed Sep. 15, 2011.

Simpson Strong-Tie Company Inc. online catalog (http://www.strongtie.com/products/connectors/LSU-LSSU.asp), date published unknown, printed Sep. 15, 2011.

Simpson Strong-Tie Company Inc. online catalog (http://www.strongtie.com/products/connectors/JB-LB-B-BA-HHB.asp), date published unknown, printed Sep. 15, 2011.

Simpson Strong-Tie Company Inc. online catalog (http://www.strongtie.com/products/connectors/LUS-HUS.asp), date published unknown, printed Sep. 15, 2011.

* cited by examiner

JOIST HANGER

CROSS REFERENCE TO RELATED APPLICATION

This application claims priority from U.S. Provisional Patent Application Ser. No. 61/536,752, filed Sep. 20, 2011, the disclosure of which is incorporated herein by reference.

BACKGROUND OF THE INVENTION

1. Technical Field

The present invention is related generally to fasteners used in building or housing construction and the method of using such fasteners. More particularly, the present invention relates to a joist hanger used for fastening a joist to a typically horizontal beam or header. Specifically, the present invention relates to a joist hanger which includes features for aligning and securing the hanger to the horizontal beam.

2. Background Information

There are a wide variety of joist hangers used for fastening a joist to a horizontal beam or header. Most joist hangers are formed from a single piece of sheet metal which is bent form the appropriate walls and other structures thereof. During use, such joist hangers are positioned by a worker against the header and secured thereto by nails. Once the hanger is secured to the header, the joist is positioned typically within a U-shaped support of the joist hanger and subsequently nailed to the header. One problem which arises in the installation of many joist hangers is the need to properly align or position the joist hanger against the header before nailing it to the header. Some joist hangers provide a mechanism for such alignment in the form of a typically horizontal hanging wall which extends from the top of the joist hanger and is seated on the top of the header at a desired height. However, if a given joist is not to be secured at the height provided by such a joist hanger, the top hanging wall may interfere with the ability to use that hanger for mounting a joist at a different height.

Another problem which arises with joist hangers is the lack of a simple securing mechanism which positively secures the hanger to the header to allow a worker to nail the hanger to the header without using a hand to hold the hanger in place while nailing. The above-noted type of hanger which includes a top hanging wall does help in holding the joist hanger in place on the header, but does not positively secure the hanger to the header whereby the hanger may be easily knocked off or slid horizontally parallel to the header whereby the worker must still hold the joist hanger in place while nailing.

Typically, a separate nail or screw must be used to positively secure the joist hanger to the header in a desired position. One exception to this rule is a joist hanger which is formed with a built-in cantilevered L-shaped nail which is formed along with the rest of the joist hanger from a single piece of sheet metal. For example, one such joist hanger is sold by Simpson Strong-Tie®, which is specifically known as a double shear joist hanger, one example of which is currently sold under the name "LUS28". Other joist hangers with such built-in cantilevered L-shaped nails or prongs are disclosed in U.S. Pat. No. 4,480,941 granted to Gibbs et al. and U.S. Pat. No. 6,523,321 granted to Leek et al. However, the use of this built-in nail nonetheless requires the worker to hold the joist hanger in place against the header while driving or hammering the built-in nail with a tool such as a hammer or nail gun into the header to secure the joist hanger to the header. More particularly, this built-in nail, which has an upper leg and a lower leg, is cantilevered from the top of the upper leg with the lower leg extending generally horizontally from the lower end of the upper leg to a free end which serves as the tip of the nail. When this joist hanger is positioned against the header, the upper leg of the nail angles forward downwardly and outwardly away from the header while the free end of the lower leg points rearwardly toward the header whereby the lower leg may be hammered into the header through a through opening formed in part of the joist hanger. Prior to the hammering process, no portion of the built-in nail extends rearwardly toward the header beyond the rear vertical surface which engages the header when positioned against the header. In addition to requiring the worker to hold the joist hanger in place while nailing the built-in nails into the header, the process of hammering these nails into the header may shift the height of the hanger relative to the header due to the fact that the nail is built in and also pivots about its upper end during the hammering process.

BRIEF SUMMARY OF THE INVENTION

The present invention provides a joist hanger comprising: a U-shaped joist support comprising a bottom wall, left and right axial joist-engaging walls which extend upwardly from adjacent the bottom wall and define therebetween a joist-receiving space, and a longitudinal wall having a header-engaging back surface which engages a header when the joist hanger is secured to the header; a nail-receiving hole formed in the longitudinal wall; and at least one tooth which is rigidly secured to the U-shaped joist support, which extends rearwardly beyond the header-engaging back surface and which is adapted to be manually pressed into a header so that the joist hanger is secured to the header solely by the at least one tooth.

The present invention also provides a method comprising the steps of: manually pressing at least one tooth of a joist hanger into a header so that the joist hanger is supported on the header solely by the at least one tooth; driving a first nail through the joist hanger into the header to further secure the joist hanger to the header; inserting an end of a joist into a joist-receiving space defined by the joist hanger; and driving a second nail through the joist hanger into the joist to secure the joist hanger to the joist.

The present invention further provides a method comprising the steps of: manually pressing at least one tooth of a joist hanger into a header so that the joist hanger is supported on the header without an additional securing mechanism of the joist hanger which extends into the header; driving a first nail through the joist hanger into the header to further secure the joist hanger to the header; inserting an end of a joist into a joist-receiving space defined by the joist hanger; and driving a second nail through the joist hanger into the joist to secure the joist hanger to the joist.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
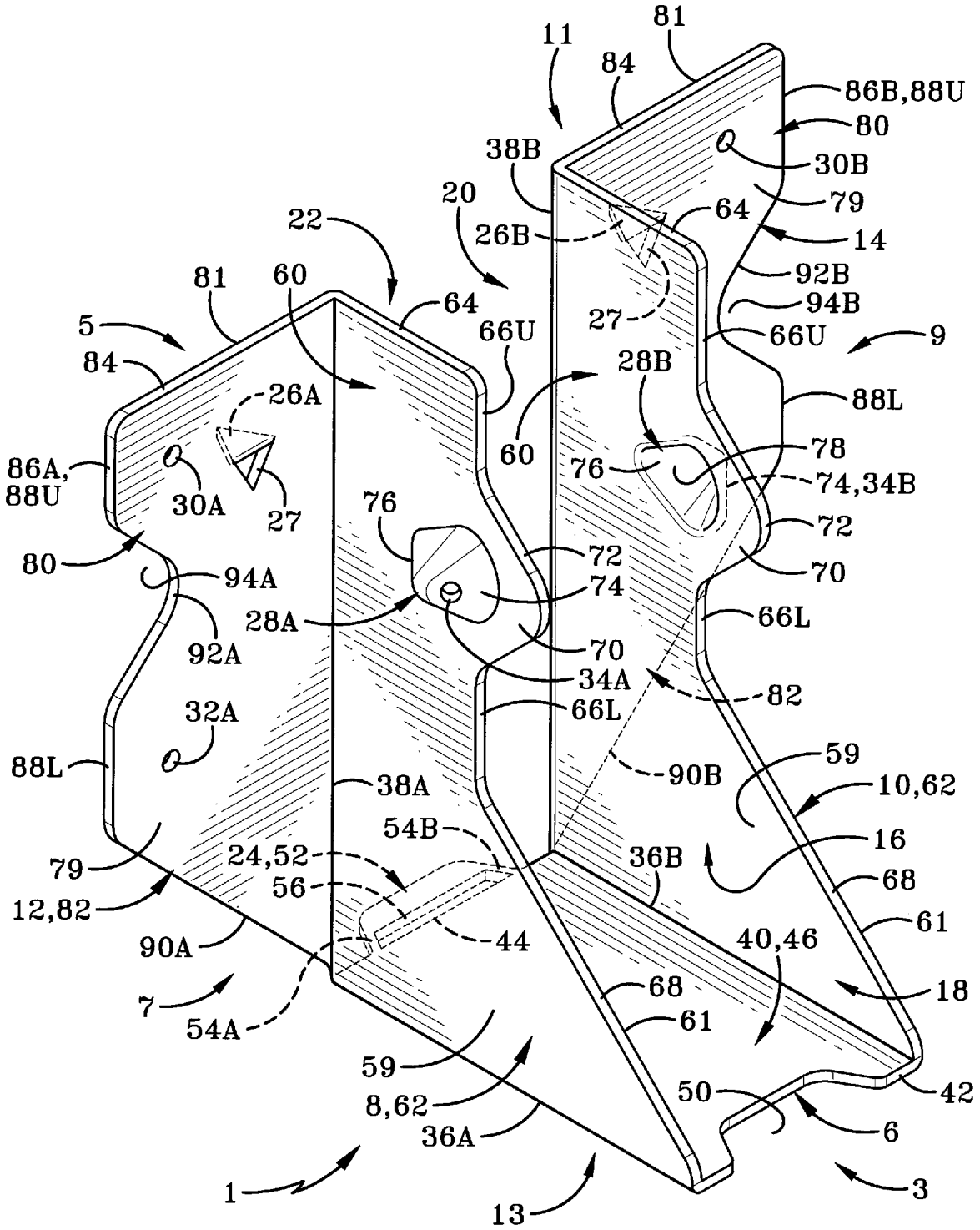
FIG. 1 is a perspective view of a first embodiment of the joist hanger of the present invention.
Figure 2:
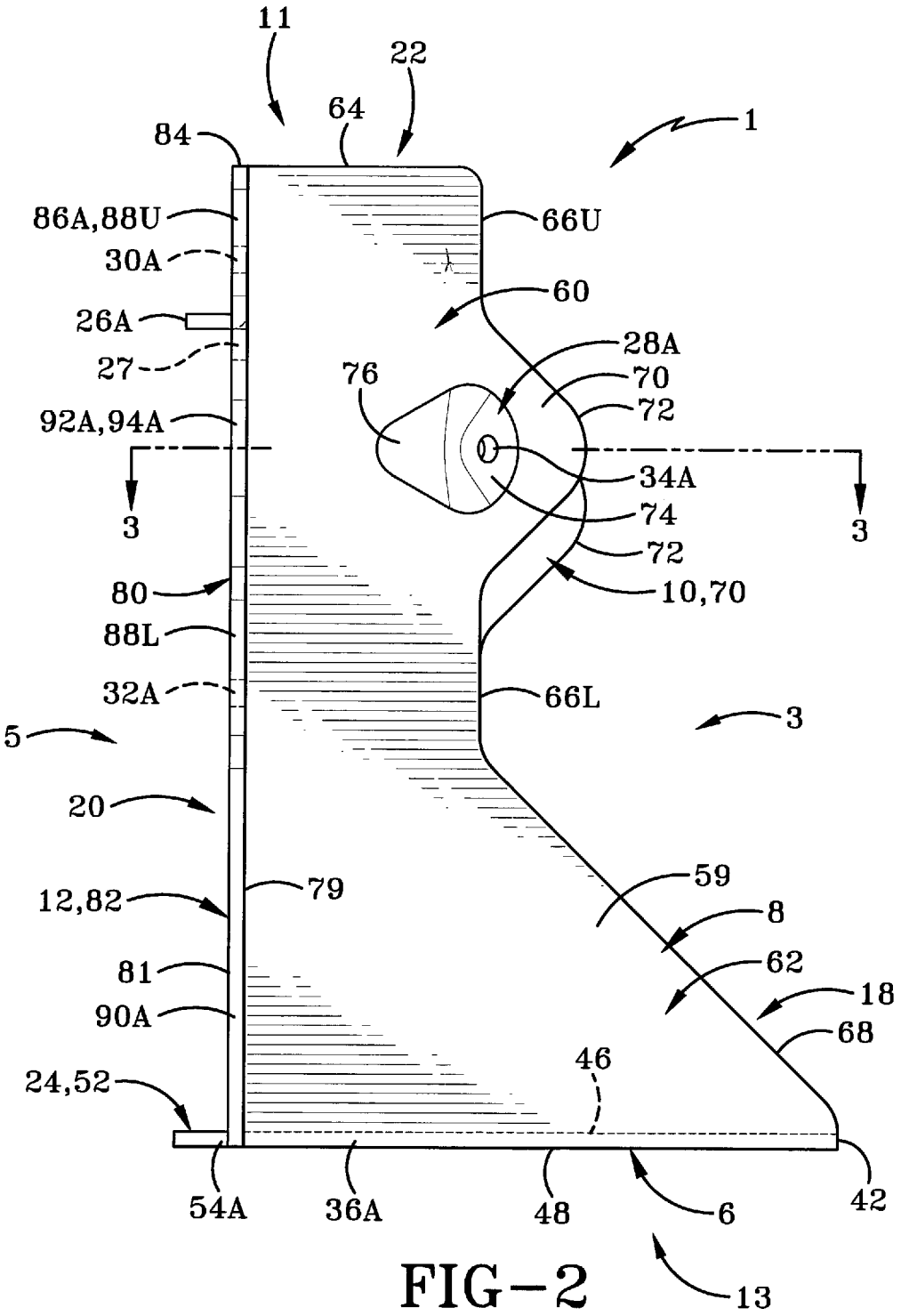
FIG. 2 is a left side elevational view of the joist hanger.
Figure 7:
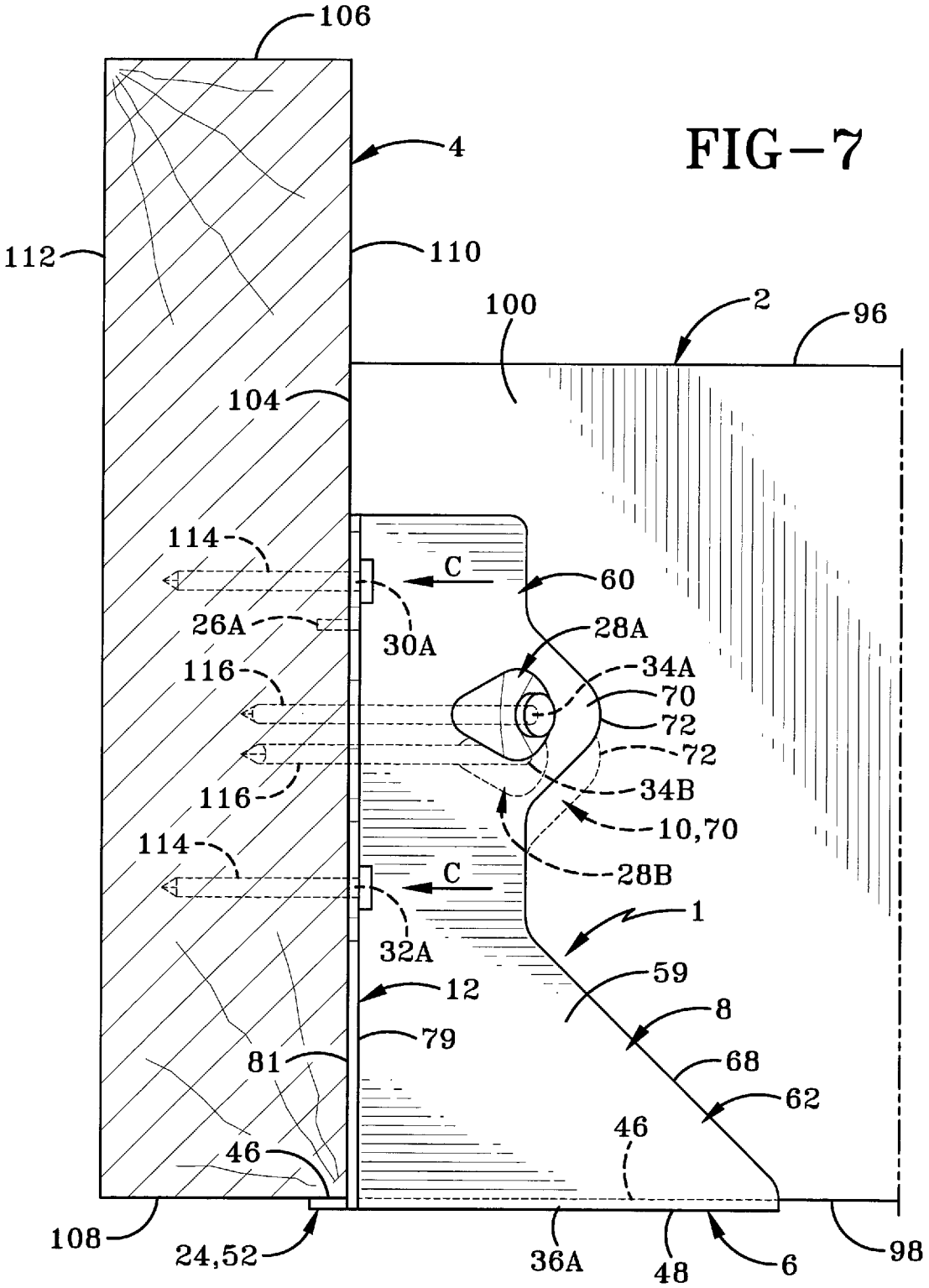
FIG. 7 is similar to FIG. 6 and shows the joist hanger nailed to the header, one end of the joist seated on the bottom wall of the joist hanger, and nails extending through the holes in the domes of the joist hanger through the end of the joist and into the header to secure the joist and hanger to the header.
Figure 8:
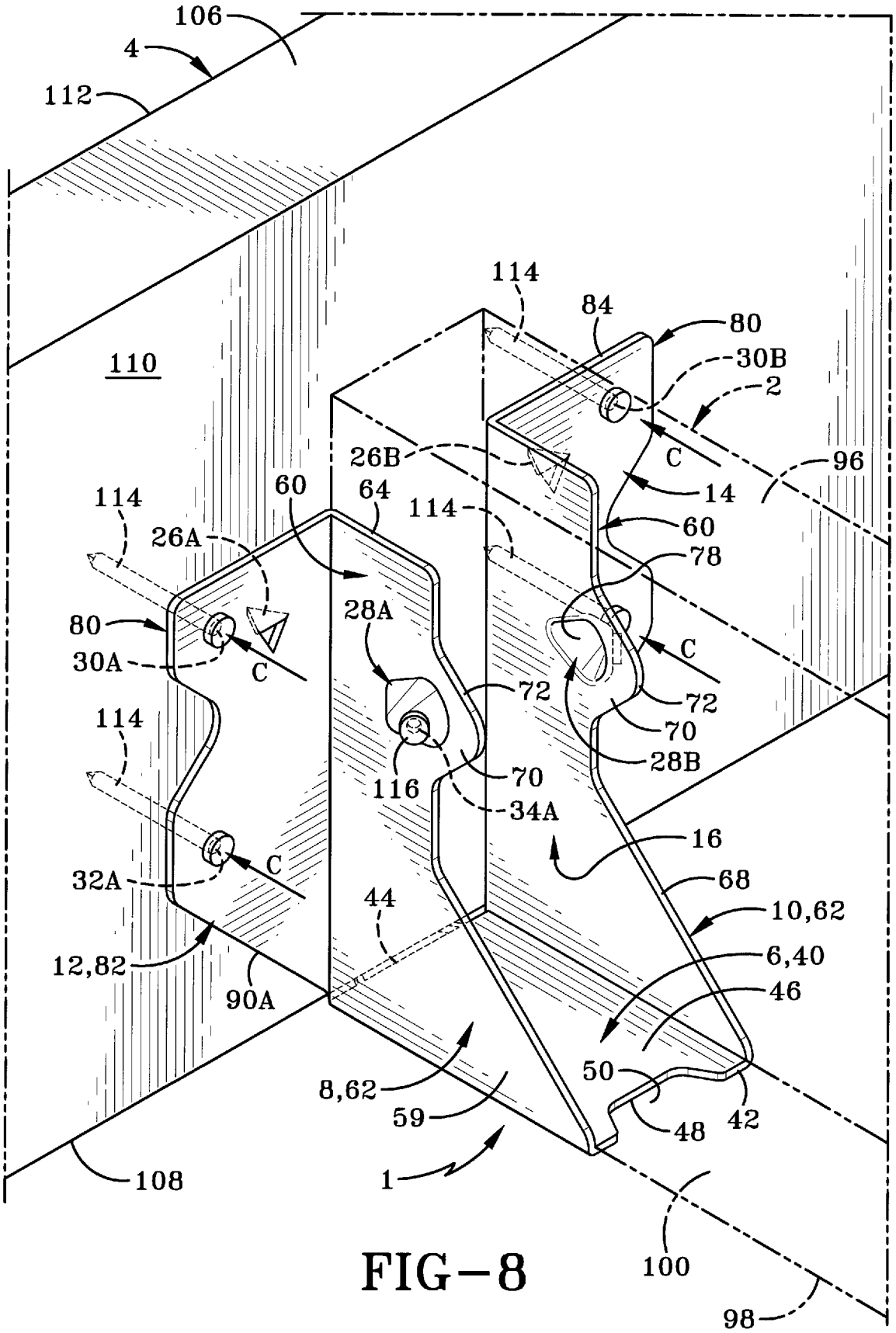
FIG. 8 is a perspective view of the secured configuration shown in FIG. 7 with the joist head, header and nails shown in dashed lines. Only the head of one of the nails which extend through the holes in the domes of the joist hanger is shown for simplicity.
Figure 9:
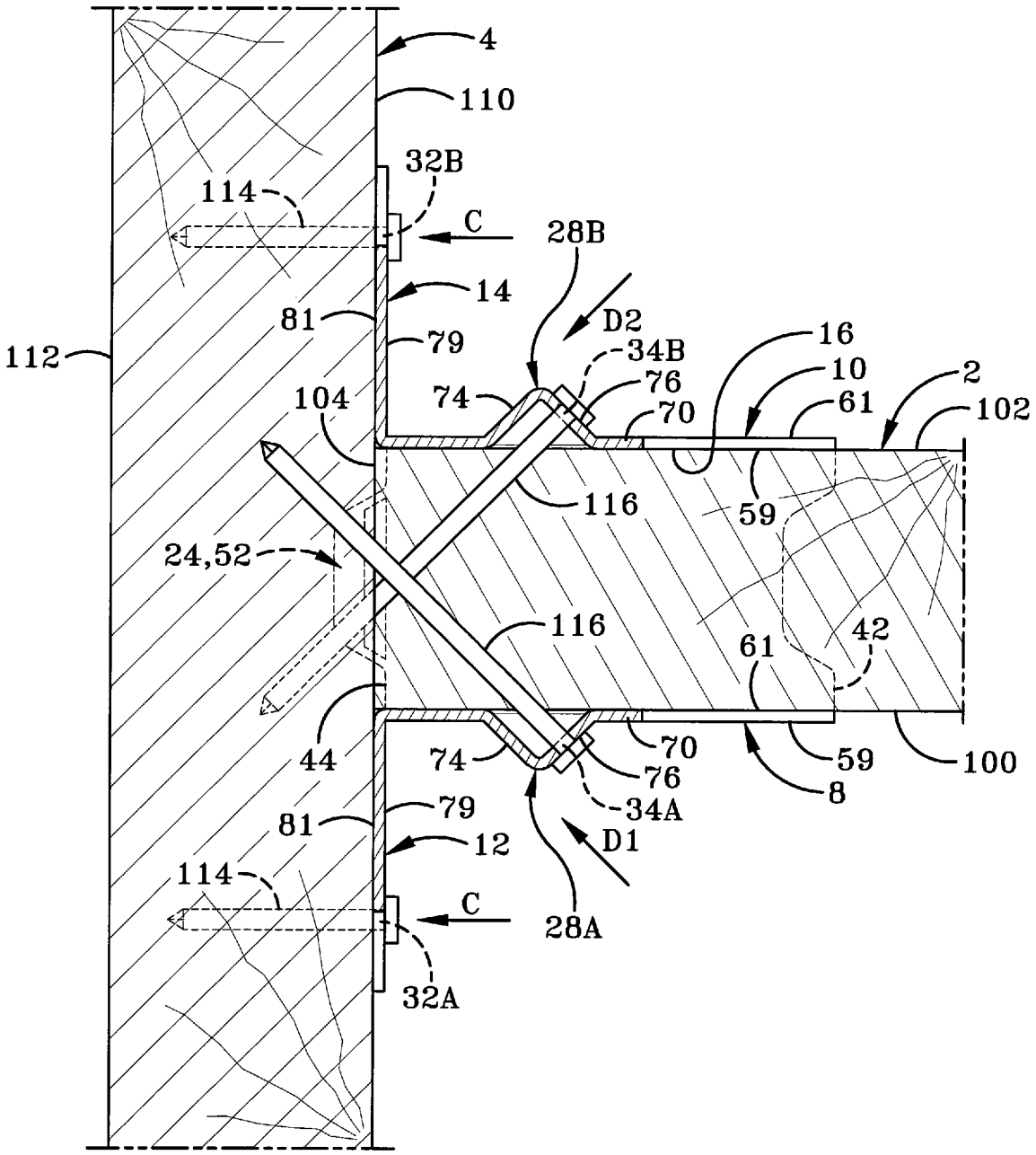
FIG. 9 is a sectional view similar to FIG. 3 additionally showing the joist in section and the secured position of in FIGS. 7 and 8.

The joist hanger of the present invention is shown generally at 1 in FIG. 1 and is used for securing a horizontal joist 2 to a horizontal beam or header 4 to form a T-shaped intersection or joint as illustrated in FIGS. 7 and 8. In the exemplary embodiment, hanger 1 is formed of a single piece of sheet metal which is bent into a generally U-shaped configuration as viewed from the front. Thus, hanger 1 is formed of a rigid material and is substantially rigid although the walls thereof may flex to some degree due to the relatively thin nature of the sheet metal. Hanger 1 has a front 3 and back 5 defining therebetween an axial direction, left and right sides 7 and 9 defining therebetween a longitudinal direction, a top 11 and a bottom 13. Hanger 1 includes a flat horizontal bottom wall 6 which is generally rectangular as viewed from above. Hanger 1 further includes parallel left and right generally flat vertical axial joist-engaging walls 8 and 10 connected to and extending perpendicularly upwardly from the left and right edges of bottom wall 6 generally parallel to one another. Left and right axial walls 8 and 10 each include flat vertical parallel axial wall segments which form nearly all of walls 8 and 10. Hanger 1 further includes coplanar left and right flat vertical longitudinal beam-engaging or header-engaging walls 12 and 14. Left and right axial walls 8 and 10 together with bottom wall 6 form a U-shaped structure or support as viewed from the front and define therebetween a joist-receiving space 16 having a front entrance opening 18, a back entrance opening 20 and a top entrance opening 22.

Bottom wall 6 includes a height-setting or height-alignment break-off tab 24 at the rear of bottom wall 6. Rigid left and right teeth 26A and 26B are respectively rigidly secured to and extend horizontally perpendicularly rearward from the back surfaces of left and right longitudinal walls 12 and 14 adjacent top 11. In the exemplary embodiment, each tooth 26 has a horizontal axial length of about 1/8 inch as defined between the tip of the given tooth and the rear surface of the wall 12, 14 from which it extends. This length of tooth 26 is typically within a range from about 1/16 or 3/32 inch to about 5/32 or 3/16 inch. As discussed below, each tooth is punched out of the piece of sheet metal from which hanger 1 is formed, and thereby leaves a through hole 27 which is immediately adjacent the tooth and typically triangular.

Left and right domes 28A and 28B are rigidly secured to and extend outwardly from left and right vertical flat axial wall segments of axial walls 8 and 10 such that left dome 28A extends outwardly to the left from the left side of the left axial wall segment of left wall 8 and right dome 28B extends outwardly to the right from the right side of the right axial wall segment of right axial wall 10. Left and right circular upper hanger-mounting nail receiving holes 30A and 30B are formed in left and right longitudinal walls 12 and 14 adjacent top 11 extending from the front to the back surfaces thereof. Similarly, left and right circular lower hanger-mounting nail receiving holes 32A and 32B are formed through walls 12 and 14 directly below the left and right upper holes 30A and B. Left and right circular joist-mounting nail receiving holes 34A and 34B are formed respectively through left and right domes 28A and B.

The bottom of left axial wall 8 is rigidly secured to the left side of bottom wall 6 at a straight horizontal axial bend or intersection 36A, which thus serves as the bottom edge of left wall 8 and the left edge of bottom wall 6. Likewise, the bottom of right axial wall 10 is rigidly secured to the right side of bottom wall 6 at a straight horizontal axial bend or intersection 38B which is parallel to bend 36A and serves as the bottom edge of right wall 10 and the right edge of bottom wall 6. Walls 8 and 10 are parallel to one another and extend perpendicularly upwardly from bottom wall 6. Left longitudinal wall 12 is rigidly connected at its right side to the back of left axial wall 8 at a straight left vertical bend or intersection 38A which thus serves as the right edge of left wall 12 and the back or rear edge of left axial wall 8. Likewise, right longitudinal wall 14 along its left side is rigidly secured to the back of right axial wall 10 at a straight right vertical bend or intersection 38B which is parallel to intersection 38A and serves as the left edge of right wall 14 and the back edge of right axial wall 10. Bends or intersections 38 are thus perpendicular to bends or intersections 36.

Bottom wall 6 includes a generally rectangular main portion or body 40 having a forward facing front edge 42 and a rearward facing back edge 44, an upwardly facing flat horizontal top surface 46 and a downwardly facing flat horizontal bottom surface 48. Since tab 24 is substantially an extension of and thus coplanar with bottom wall 6, the top surface 46 of bottom wall 6 also serves as a coplanar top surface of tab 24, and bottom surface 48 likewise serves as a coplanar bottom surface of tab 24. Front edge 42 defines a U-shaped recess 50 which extends rearwardly from the frontmost left and right portions of edge 42.

Figure 3:
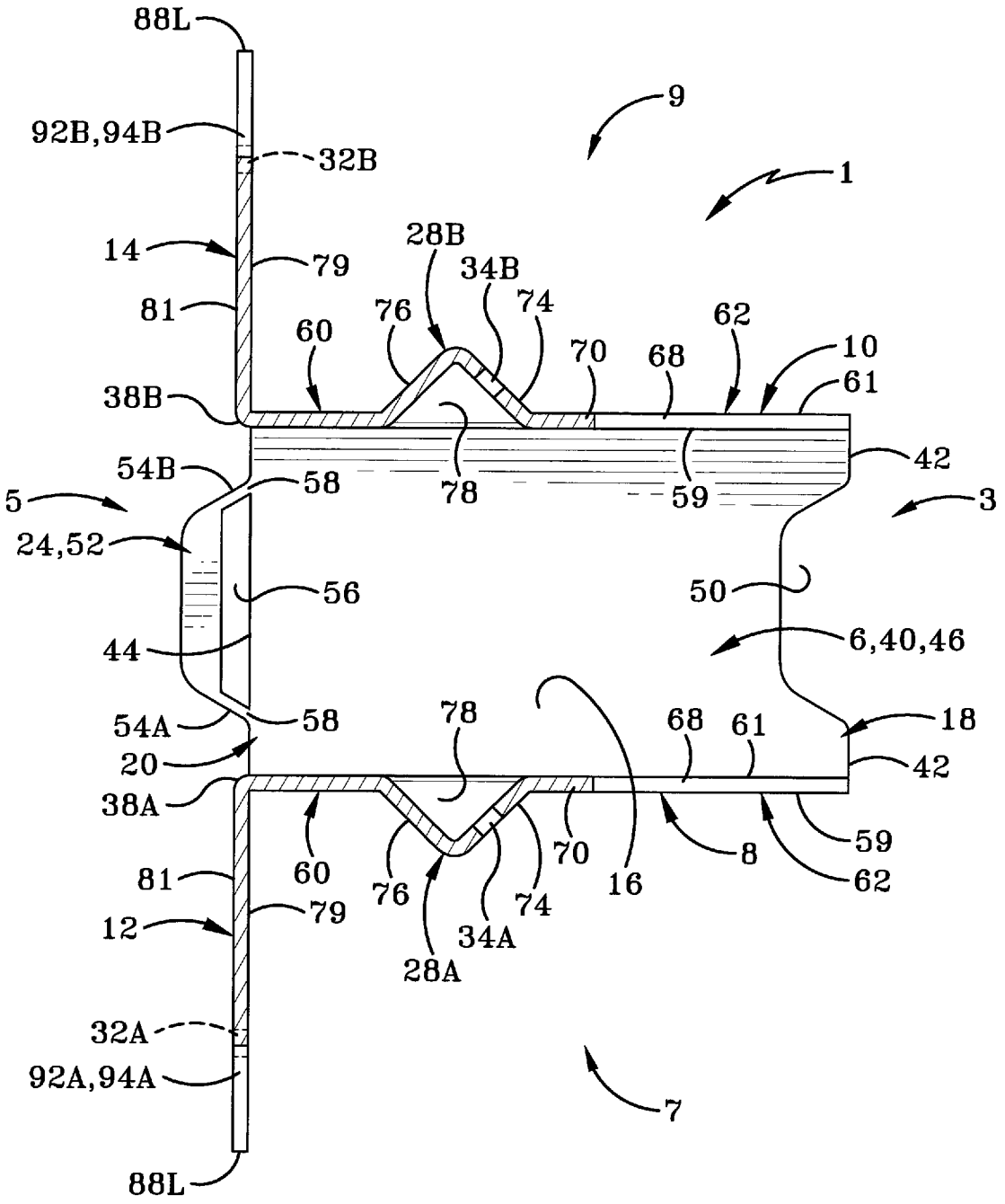
FIG. 3 is a sectional view taken on line 3-3 of FIG. 2.

With primary reference to FIG. 3, tab 24 includes a longitudinal body 52 which is substantially parallel to, adjacent and spaced rearwardly from back edge 44 and thus rearwardly from the U-shaped joist support beyond header-engaging back surface 81. Tab 24 further includes left and right legs 54A and 54B which are rigidly secured to the left and right ends of body 52 and extend forward therefrom to a rigid connection with back edge 44. A longitudinal through hole or slot 56 is formed in bottom wall 6 from top surface 46 to bottom surface 48 and is defined between legs 54A and 54B, the front of body 52 and a portion of back edge 44 extending between legs 54A and 54B. Each of legs 54 is connected to back edge 44 at a fracture zone or break-off zone 58 which is typically crimped so that the fracture zone is thinner than the remaining portions of legs 54. Typically, this crimping is done during the pressing or punching of the sheet metal to form hanger 1 so that the fracture zones 58 are vertically thinner than the thickness of the sheet metal to facilitate breaking off tab 24 from the U-shaped joist support.

Walls 8 and 10 are nearly identical to one another with an exception noted further below. Each of walls 8 and 10 has flat vertical axial left and right sides 59 and 61 which are parallel to one another. Each of walls 8 and 10 has a rectangular portion 60 and a triangular portion 62 connected to the front of the lower portion of rectangular portion 60 and extending forward therefrom to adjacent front end 3 and front edge 42. Each of walls 8 and 10 has a horizontal axial top edge 64 which is defined by the respective top of the rectangular portion 60. Each of rectangular portions 60 has a forward facing vertical front edge 66 which is divided into upper and lower segments 66U and 66L which are vertically spaced from one another. Triangular portion 62 has an angled front edge 68 which faces upwardly and forward and extends downwardly and forward from the bottom of lower segment 66L to adjacent front 3 and front edge 42. Each of walls 8 and 10 further includes a U-shaped projection 70 which projects forward from rectangular portion 60 and has a convex U-shaped front edge 72 which generally faces forward and extends downwardly and forward from the bottom of upper segment 66U to a forwardmost point, and therefrom downwardly and rearwardly to the top of lower segment 66L.

Although each of projections 70 has the same shape and dimensions as viewed from the side, projection 70 of wall 10 is a little bit lower than projection 70 of wall 8 whereby dome 28B is a little lower than dome 28A and hole 34B is a little lower than hole 34A. Thus, upper segment 66U of right wall 10 is a little longer than upper segment 66U of left wall 8, and lower segment 66L of right wall 10 is a little shorter than lower segment 66L of left wall 8. These different heights of projections 70 are related to the difference in heights of holes 34A and 34B so that the nails which ultimately extend through holes 34A and 34B are slightly vertically offset from one another when they are horizontal. In the exemplary embodiment, the difference in height between holes 34A and 34B is about 7/32 inch and typically in the range of about 3/16 to 5/16 or 3/8 inch although this may vary. Thus, the difference in vertical length of upper segment 66U of right wall 10 and upper segment 66U of left wall 8 is in the same range, as is the difference between the vertical length of the lower segments 66L.

Each of domes 28 has a front half 74 and a back half 76 and defines a recess 78 which communicates with space 16. Front half 74 of left dome 28A is rigidly secured to U-shaped projection 70 of left wall 8 and extends rearward and to the left therefrom at about a 45-degree angle relative to wall 8. Back half 76 of left dome 28A is rigidly secured to rectangular portion 60 and extends forward and to the left therefrom at about an opposite 45-degree angle to meet front half 74 at a leftmost peak of dome 28A. Hole 34A is formed through front half 74 of dome 28A. The left recess 78 thus extends to the left from the left side of space 16 and right side 61 of left wall 8. Hole 34A communicates with the left recess 78.

Right dome 28B is substantially a mirror image of left dome 28A. Thus, front half 74 of dome 28B is rigidly secured to the projection 70 of right wall 10 and extends rearward and to the right therefrom at about a 45-degree angle relative to wall 10. Back half 76 of right dome 28B is rigidly secured to rectangular portion 60 of wall 10 and extends forward and to the right at about an opposite 45-degree angle therefrom to a rigid connection with front half 74 at a rightmost peak of dome 28B. The right recess 78 of dome 28B thus extends to the right from the right side of space 16 and left surface 59 of wall 10. Hole 34B is formed through front half 74 of dome 28B and communicates with the right recess 78.

Left and right longitudinal vertical walls 12 and 14 have coplanar vertical flat front surfaces 79 and coplanar vertical flat rear surface 81 which are parallel to front surfaces 79 and lie along respective parallel vertical longitudinal planes. Each of walls 12 and 14 has an upper rectangular portion 80 and a lower triangular portion 82 which is rigidly secured to the bottom of rectangular portion 80 and extends downwardly therefrom directly below portion 80. Rectangular portion 80 has a horizontal longitudinal top edge 84 which serves as the top edge of a given wall 12 and 14. The rectangular portions 80 of walls 12 and 14 have respective left and right straight vertical side edges 86A and 86B each having upper and lower segments 88U and 88L wherein the lower segments are spaced downwardly from the upper segments. Each of the triangular portions 82 of walls 12 and 14 have respective left and right angled edges 90A and 90B. The left edge of left wall 12 further includes a left concave U-shaped edge 92A which faces generally leftward and defines a left U-shaped recess 94A. Likewise, the right edge of wall 14 further includes a right concave U-shaped edge 92B which faces to the right and defines a right U-shaped recess 94B.

Regarding left longitudinal wall 12, the right end of top edge 84 intersects the back end of top edge 64 at the top of intersection 38A and extends perpendicularly and horizontally to the left therefrom. The top of upper segment 88U intersects the left end of top edge 84 and extends vertically downward therefrom. The top of edge 92A is connected to and extends downwardly and to the right from the bottom of segment 88U to a rightmost point and then to the left and downwardly to its bottom end. The top end of lower edge segment 88L is connected to the bottom of segment 92A and extends vertically downwardly therefrom. The top of left angled edge 90A is connected to and extends downwardly and to the right from the bottom of lower segment 88L to a bottom end adjacent the intersection between the left end of back edge 44 and the back end of left intersection 36A. As discussed later, joist hanger 1 is punched or otherwise cut from a piece of sheet metal so that the left edge of left wall 12 mates in an identical manner with the front edge of left wall 8. Thus, if left wall 12 were removed from left wall 8 and rotated 90 degrees so that the left edge of left wall 12 faced rearwardly, it would fit in a mating fashion with the front edge of left wall 8 whereby the two edges would be in continuous contact from the top thereof to the bottom thereof. Thus, upper segment 88U has a mating configuration with upper segment 66U, edge 92A has a mating configuration with edge 72, lower segment 88L has a mating configuration with lower segment 66L, and angled edge 90A has a mating configuration with angled edge 68 of left wall 8.

Regarding right longitudinal wall 14, the left end of top edge 84 intersects the back end of top edge 64 at the top of intersection 38B and extends perpendicularly and horizontally to the right therefrom. The top of upper segment 88U intersects the right end of top edge 84 and extends vertically downward therefrom. The top of edge 92B is connected to and extends downwardly and to the left from the bottom of segment 88U to a leftmost point and then to the right and downwardly to its bottom end. The top end of lower edge segment 88L is connected to the bottom of segment 92B and extends vertically downwardly therefrom. The top of left angled edge 90B is connected to and extends downwardly and to the left from the bottom of lower segment 88L to a bottom end adjacent the intersection between the right end of back edge 44 and the back end of right intersection 36B. The right edge of right wall 14 mates in an identical manner with the front edge of right wall 10. Thus, if right wall 14 were removed from right wall 10 and rotated 90 degrees so that the right edge of right wall 14 faced rearwardly, it would fit in a mating fashion with the front edge of right wall 10 whereby the two edges would be in continuous contact from the top thereof to the bottom thereof. Thus, upper segment 88U has a mating configuration with upper segment 66U, edge 92B has a mating configuration with edge 72, lower segment 88L has a mating configuration with lower segment 66L, and angled edge 90B has a mating configuration with angled edge 68 of right wall 10.

As noted previously, projection 70 of right wall 10 is a little lower than projection 70 of left wall 8. Thus, the front edge of wall 8 and the front edge of right wall 10 are similar but different from one another. Likewise, right edge 92B and right recess 94B are lower than left edge 92A and left recess 94A to the same degree. Thus, the left edge of left wall 12 would not have a mating configuration with the front edge of right wall 10 from the top to the bottom thereof. Similarly, the right edge of right wall 14 would not have a mating configuration from top to bottom with the front edge of left wall 8. The back edge of tab 24 and the left and right segments of back edge 44 have a mating configuration with the front edge 42 of bottom wall 6. Thus, the rear edge of a tab 24 and the left and right segments of back edge 44 of a given hanger 1 would mate with the front edge 42 of another hanger 1 with tab 24 received within recess 50 and the two edges in contact with one another from the left end to the right end. With the exception of the difference in heights of projections 70 and the corresponding different lengths of upper and lower segments 66U and 66L, hanger 1 is bilaterally symmetrical about a vertical axial center plane.

Figure 4:
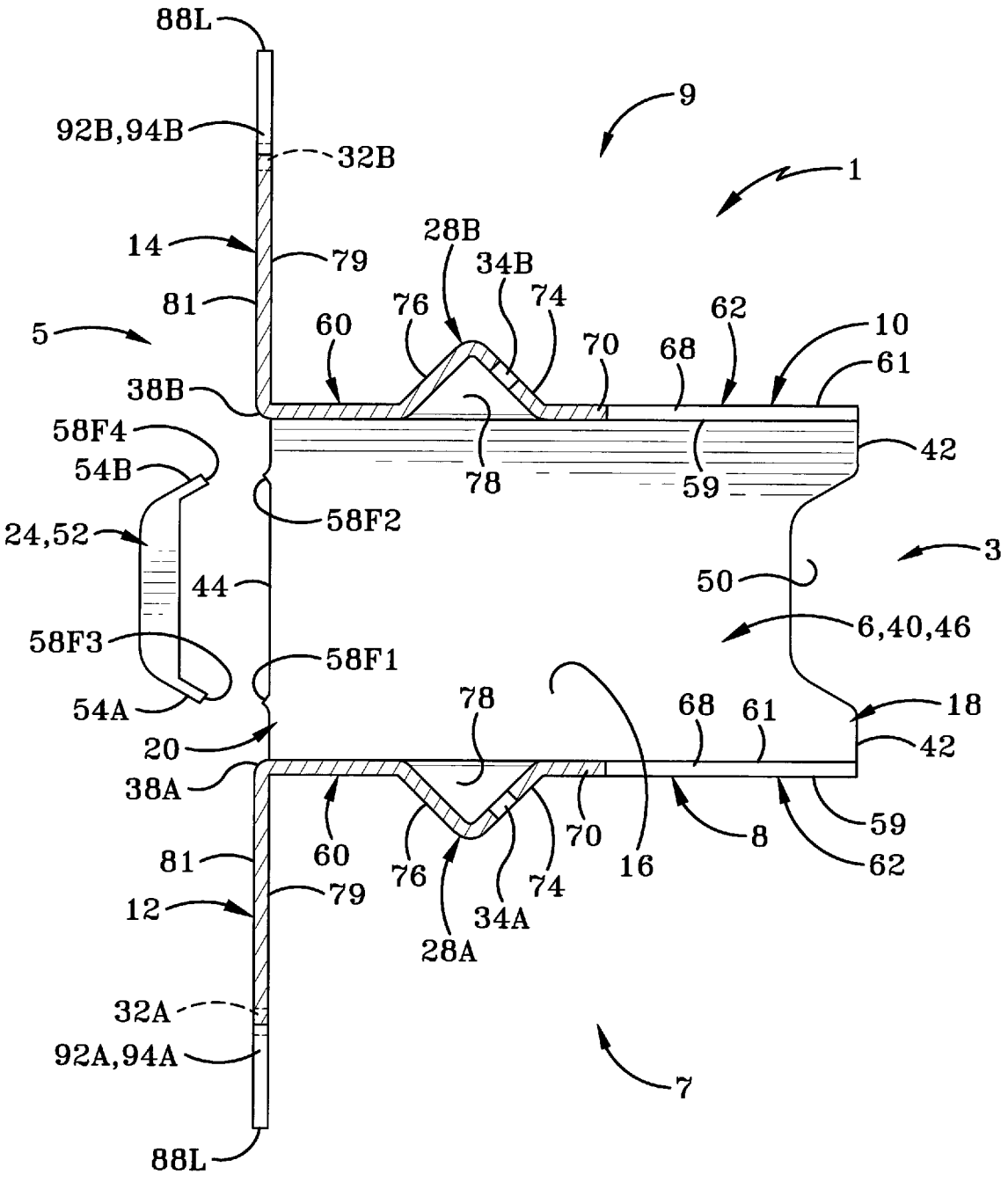
FIG. 4 is similar to FIG. 3 and shows the height alignment break-off tab broken off and separate from the remainder of the joist hanger.

FIG. 4 illustrates the use of break-off tab 24. More particularly, FIG. 4 shows tab 24 having been broken off at fracture zones 58 (FIG. 3) so that tab 24 is separate from the remainder of joist hanger 1. The breaking or fracturing of tab 24 along the fracture zones thus produces broken or fractured surfaces 58F1 and 58F2 along back edge 44 of main body 40 of bottom wall 6 and broken off fractured surfaces 58F3 and 58F4 respectively on the front ends of legs 54A and 54B. Fracture zones 58 may be configured so that a worker can grasp tab 24 manually and break it off or use a pair of pliers or other tool to increase the leverage if necessary to break tab 24 off of the remainder of the hanger. When tab 24 is broken off or when joist hanger 1 is formed without tab 24, no portion of the joist hanger extends rearwardly beyond the header-engaging back surface other than teeth 26. When joist hanger 1 includes tab 24 and tab 24 remains attached to the remainder of hanger 1, no portion of the joist hanger extends rearwardly beyond the header-engaging back surface other than teeth 26 and tab 24.

Figure 5:
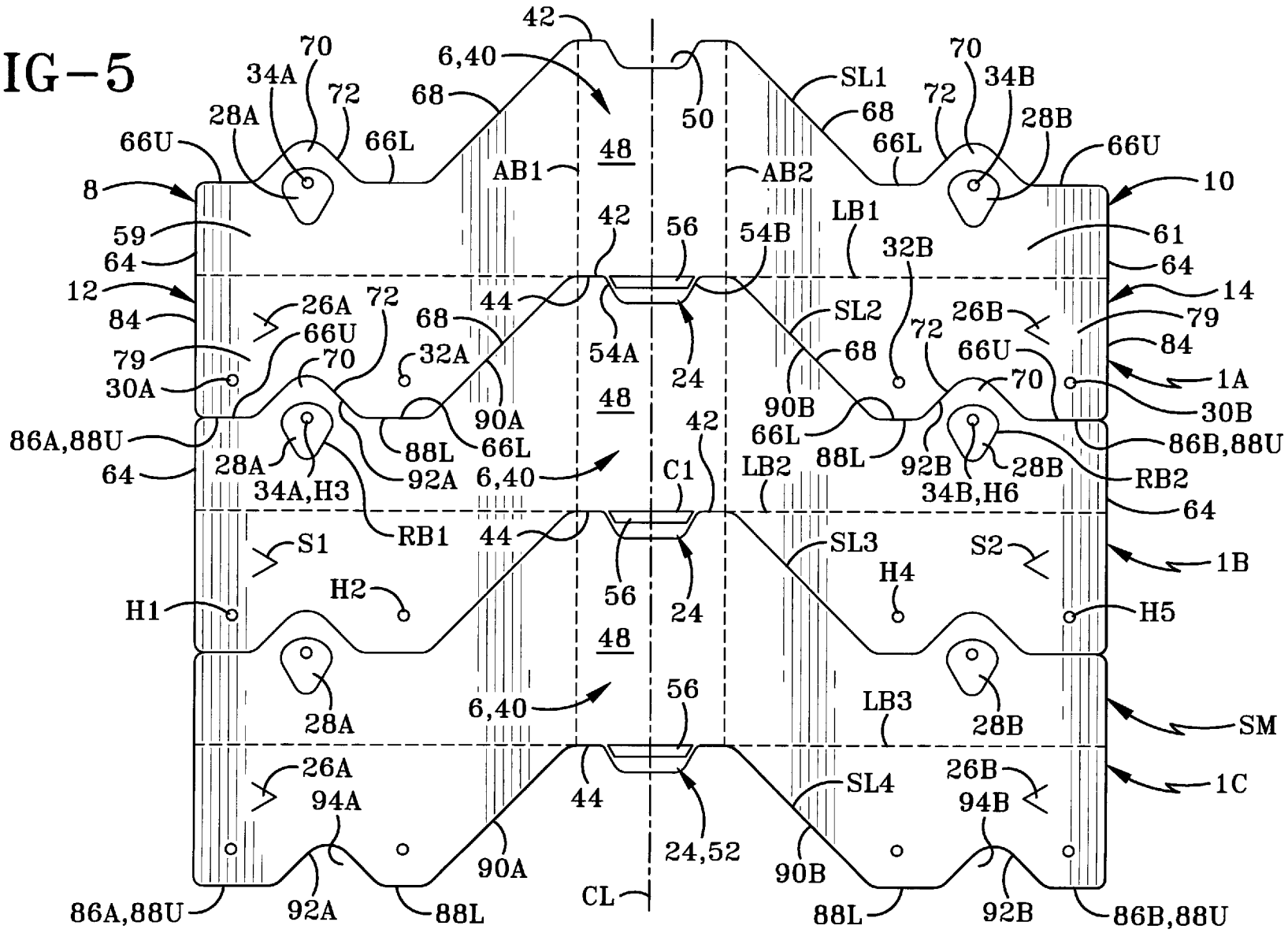
FIG. 5 is a bottom plan view of a piece of sheet metal illustrating cut lines and bend lines used in the formation of the joist hanger.

FIG. 5 shows the piece of sheet metal SM from which joist hangers 1 are formed. More particularly, FIG. 5 shows that piece SM has cut lines or sever lines SL1, SL2, SL3 and SL4. The original piece of sheet metal has already been cut or severed at line SL1 and line SL4 to form edges along a portion 1A of piece SM which will ultimately become a joist hanger 1 and to form an edge along another portion 1C which will also ultimately become another joist hanger 1. The cut or sever lines SL2 and SL3 are shown in solid lines to facilitate an understanding of a formation process although these are imaginary lines. Once the piece SM has been cut along lines SL2 and SL3 each of portions 1A, 1B and 1C are separated from one another. The cutting along the various cut lines or sever lines is typically done by a punching or pressing process in which the piece SM is sheared along the various sever lines. At the same time or separately from the cutting along lines SL1-SL4, the piece of sheet metal may be cut along hole cut lines H1-H6 (for example, by pressing, punching or drilling) to respectively form holes 30A, 32A, 34A, 32B, 30B and 34B. Likewise, the sheet metal may be cut along a cut line C1 at the same time or separately to form slot 56. Also at the same time or separately, the sheet metal may be cut along V-shaped or U-shaped slits or cut lines S1 and S2 to respectively form teeth 26A and 26B and the corresponding V-shaped or U-shaped holes 27. Further, the sheet metal may be bent along an annular or ring-shaped bend RB1 and RB2 to respectively form domes 28A and 28B. The piece of sheet metal SM is also bent along parallel axial bend lines AB1 and AB2 which are on opposed sides of, parallel to and equidistant from an axial center line CL (or vertical axial center plane) to respectively form bends 36A and 36B. The piece SM of sheet metal is also bent along longitudinal bend lines LB1, LB2 and LB3 which are parallel to one another and perpendicular to bend lines AB1 and AB2 to form the vertical bends 38A and 38B. Inasmuch as FIG. 5 is a bottom plan view of the piece of sheet metal, the longitudinal bends LB1, LB2 and LB3 are downward bends of 90 degrees, whereas the axial bends AB1 and AB2 are upward bends of 90 degrees.

The method of securing joist 2 to header 4 will be described with reference to FIGS. 6-10 after a brief additional description of joist 2 and header 4. With reference to FIGS. 7-10, joist 2 has flat horizontal top and bottom surfaces 96 and 98, flat vertical left and right sides 100 and 102, and a flat vertical back end 104. Joist 2 is axially elongated between end 104 and an opposed end not shown in the drawings. Thus, surfaces 96 and 98 and sides 100 and 102 are axially elongated. Beam or header 4 likewise has flat horizontal top and bottom surfaces 106 and 108, a vertical first or front side 110 and a vertical second or back side 112. Header 4 is longitudinally elongated between opposed ends not shown in the drawings whereby surfaces 106 and 108 and sides 110 and 112 are likewise longitudinally elongated.

Figure 6:
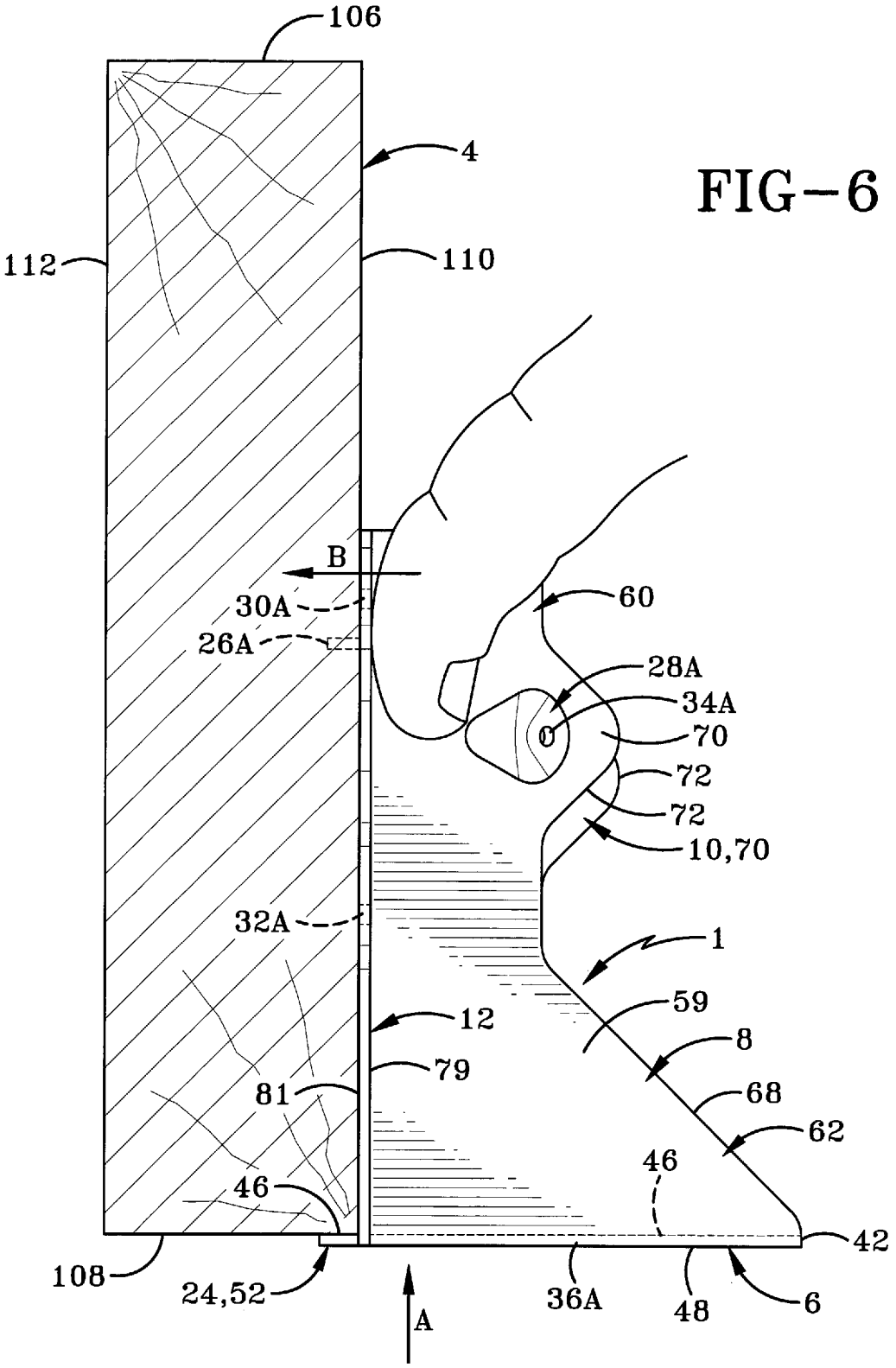
FIG. 6 is a side elevational view of the joist hanger mounted on a header with the height alignment tab engaging the bottom of the header and the teeth positively securing the joist hanger to the header.

Referring now to FIG. 6, the initial mounting of joist hanger 1 on header 4 is first described. Hanger 1 is moved generally upwardly (Arrow A) so that the top surface 46 of tab 24 abuts the bottom surface 108 of header 4 in order to properly set the height of hanger 1 relative to header 4. While top surface 46 of tab 24 remains engaged with bottom surface 108, the worker will manually push, press or force hanger 1 horizontally rearwardly (Arrow B) so that teeth 26 are forced or inserted through vertical front surface 110 into header 4 with rear header-engaging surface 81 typically abutting or very closely adjacent front surface 110. This simple manual manipulation thus both sets the height of the joist hanger 1 and also positively secures it to header 4 such that hanger 1 is secured to header 4 solely by teeth 26 and thus without an additional securing mechanism of joist hanger 1 which extends into header 4. At this point, prior to hanger 1 being secured by separate nails to header 4, hanger 1 is in its final position for use in supporting one end of joist 2. Teeth 26 thus support the entire weight of hanger 1 on header 4 and allow the worker to take his or her hands off of hanger 1 while subsequently manipulating a hammer and nails or a nail gun into position and nailing hanger 1 to header 4 with nails 114. Because the entire joist hanger 1 is supported by teeth 26 inserted into header 4, there is no need for the additional material to create a hanging wall to hang the joist hanger 1 from the top of the header and thus no portion of joist hanger 1 extends directly above or contacts top surface 106 of header 4. When hanger 1 is supported only by teeth 26 on header 4, hanger 1 may be removed by hand relatively easily by pulling forward on hanger 1 away from surface 110 of header 4 although hanger 1 will not fall off of header 4 absent such a forward force on hanger 1.

Once hanger 1 is secured to header 4 by teeth 26, the user of hanger 1 will hammer or drive nails 114 with a tool such as a hammer or nail gun substantially horizontally and in the axial direction (Arrows C in FIGS. 7-9) through joist hanger 1 into header 4, particularly through holes 30A, 30B, 32A and 32B. At this stage, hanger 1 is rigidly secured to header 4 (and thus no longer removable from header 4 merely by hand without the use of tools to apply sufficient force to remove nails 114) and ready to receive the end of joist 2 within receiving space 16. More particularly, joist 2 is inserted into space 16 so that end 104 abuts or is closely adjacent to front surface 110 of header 4, bottom surface 98 is seated atop and abutting top surface 46 of bottom wall 6, left side 100 abuts or is closely adjacent the inner right surface 61 of left axial wall 8 and right side 102 is abutting or closely adjacent left inner surface 59 of right axial wall 10. In the exemplary embodiment, tab 24 is situated so that the top surface 46 of tab 24 and bottom wall 6 is at substantially the same height as bottom surface 108 of header 4, and whereby bottom surface 98 of joist 2 is likewise substantially at the same height as bottom surface 108 of header 4. Once joist 2 is thus positioned within hanger 1, a worker will hammer or drive nails 116 through joist hanger 1 into joist 2. In particular the worker will drive nails 116 respectively through holes 34A and 34B such that the nails 116 cross one another as viewed from above, are substantially perpendicular to one another and are at about 45-degree angles relative to surfaces 100 and 102 and end 104 of joist 2 and surface 110 of header 4. More particularly, the left nail 116 is hammered in the direction indicated at Arrow D1 in FIG. 9 while the right nail 116 is hammered in the direction indicated at Arrow D2 in FIG. 9 whereby nails 116 are forced through the end portion of joist 2 through end 104 and surface 110 into header 4 in order to secure hanger 1, joist 2 and header 4 to one another. More particularly, nails 116 secure joist 2 to header 4 and further secure hanger 1 to joist 2 and header 4.

Figure 10:
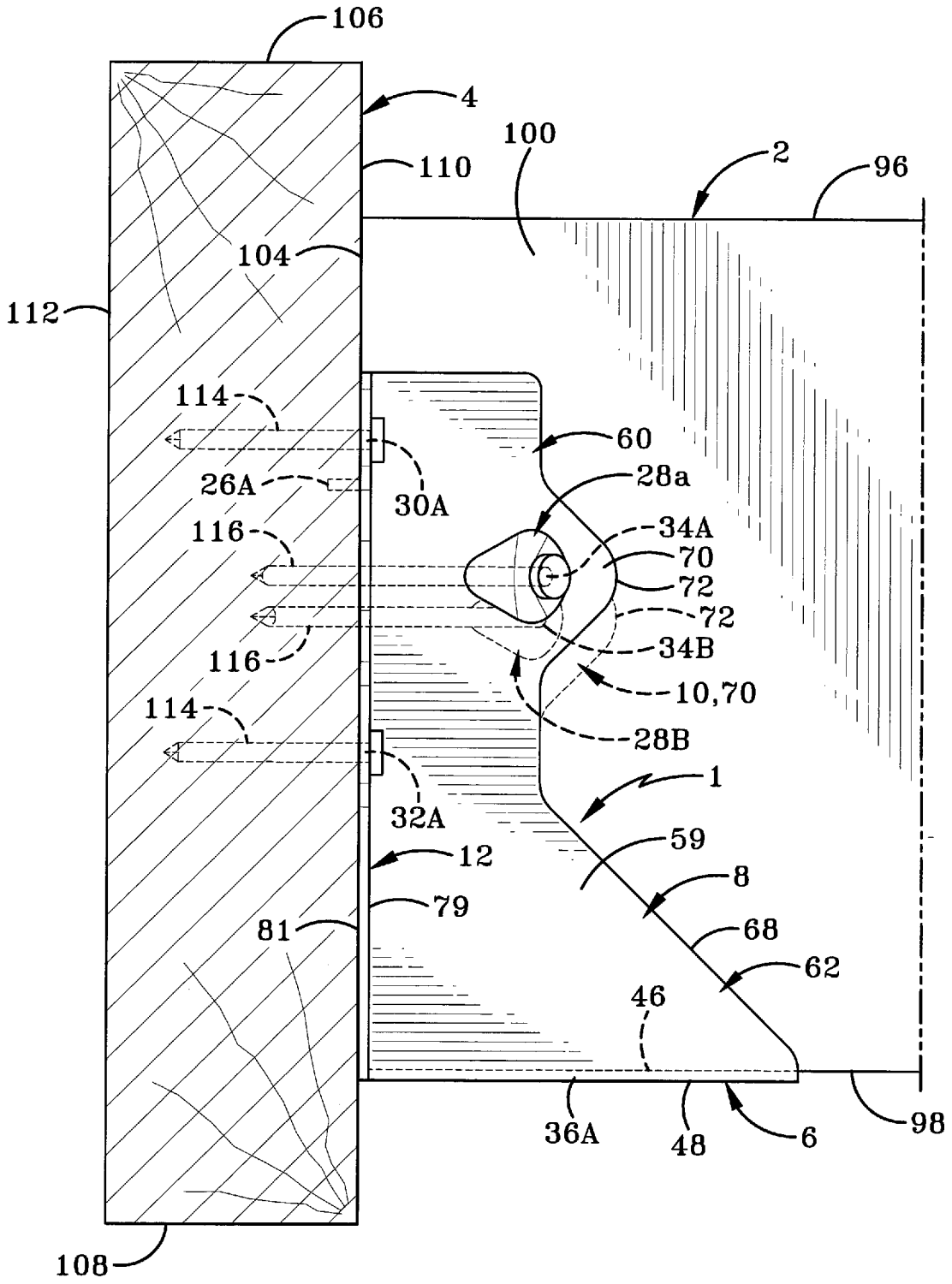
FIG. 10 is similar to FIG. 7 and shows the joist hanger used with the height alignment tab broken off to allow the vertical adjustment of the joist hanger relative to the header prior to securing the joist hanger and the joist to the header.

FIG. 10 further illustrates the use of joist hanger 1 after tab 24 has been broken off as previously described mainly with reference to FIG. 4. The method of using a joint hanger 1 without tab 24 is similar to the method described immediately above except that the user of hanger 1 is able to vertically adjust hanger 1 relative to header 4 to position hanger 1 at any desired height inasmuch as the removed tab 24 is no longer available to engage bottom surface 108 of header 4. As shown in FIG. 10, hanger 1 is thus positioned with bottom wall 6 spaced upwardly of or higher than bottom surface 108 of header 4 whereby bottom surface 98 of joist 2 may likewise be positioned higher than bottom surface 108. Thus, the only distinction between using hanger 1 without tab 24 is the manual positioning of hanger 1 at a desired height without a built in height setting mechanism. Otherwise, the user presses hanger 1 horizontally rearwardly in order to insert teeth 26 into header 4 in the same manner as previously described, after which nails 114 and 116 are used to secure the assembly in the same manner.

Although hanger 1 in the exemplary embodiment is configured for use with a single joist 2, it may also be configured to receive and secure more than one joist to a header. For instance, walls 8 and 10 may be spaced further apart from one another to receive a pair of side-by-side joists therebetween. In addition, a similar hanger may be formed to receive a joist which is taller whereby the hanger may be formed with taller axial and longitudinal walls and additional nail-receiving holes analogous to holes 30 and 32 as well as additional domes analogous to domes 28 and with associated holes like holes 34. It is also noted that hanger 1 is formed without various structures found in certain other joist hangers or similar structures. For instance, hanger 1 is free of a hanging wall (such as described in the Background section of the present application) which extends from the top of the hanger to be seated on or engage the top surface of a header for hanging the hanger on the header. Hanger 1 is also free of the L-shaped or other built-in nails (such as described in the Background section) which must be hammered or otherwise driven into the header with a hammer or other tool to secure the hanger to the header. Further, although hanger 1 may include additional structure, it is typically formed as shown in the Figures without additional structure so that hanger 1 meets the strength requirements while using as little sheet metal as possible, whereby Applicant reserves the right to claim the invention as being free of such additional structure to define the invention over prior art structures of which Applicant may not currently be aware.

Figure 11:
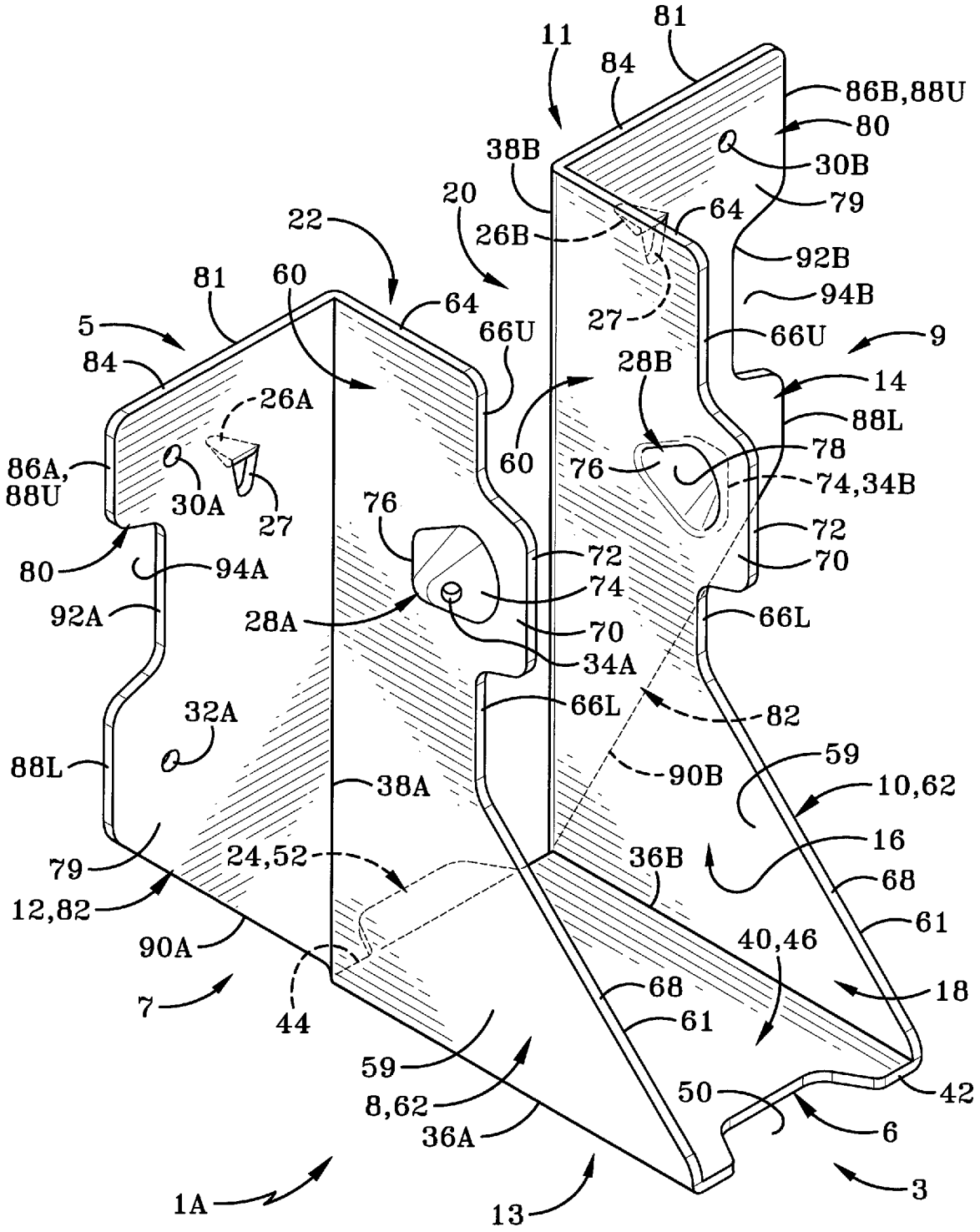
FIG. 11 is a perspective view of a second embodiment of the joist hanger of the present invention which is similar to the first embodiment and includes slightly modified teeth and a modified height-setting break-off tab.
Figure 12:
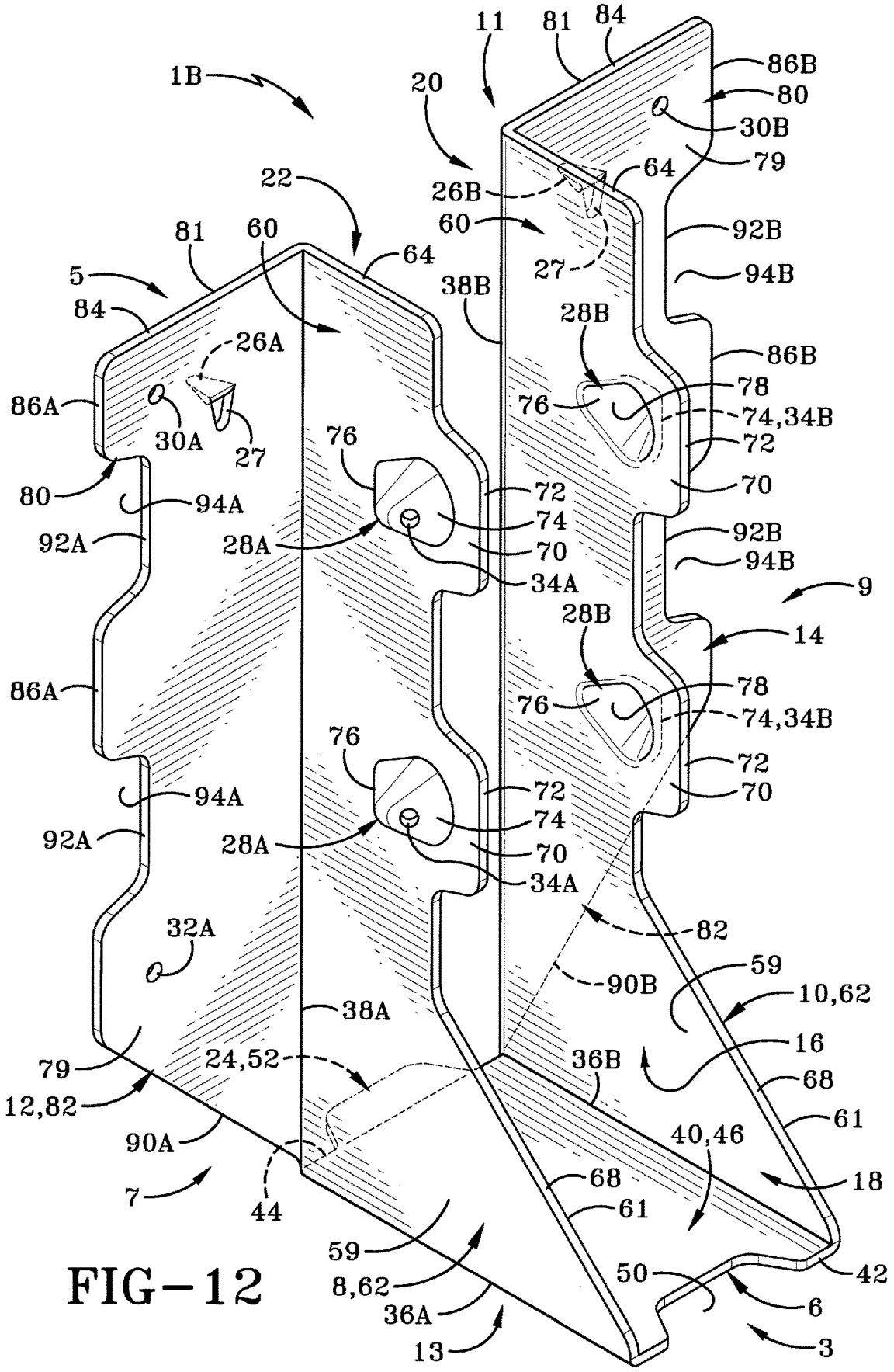
FIG. 12 is a perspective view of a third embodiment of the joist hanger of the present invention which is taller than the first and second embodiments and configured to accommodate an accordingly larger joist.
Figure 13:
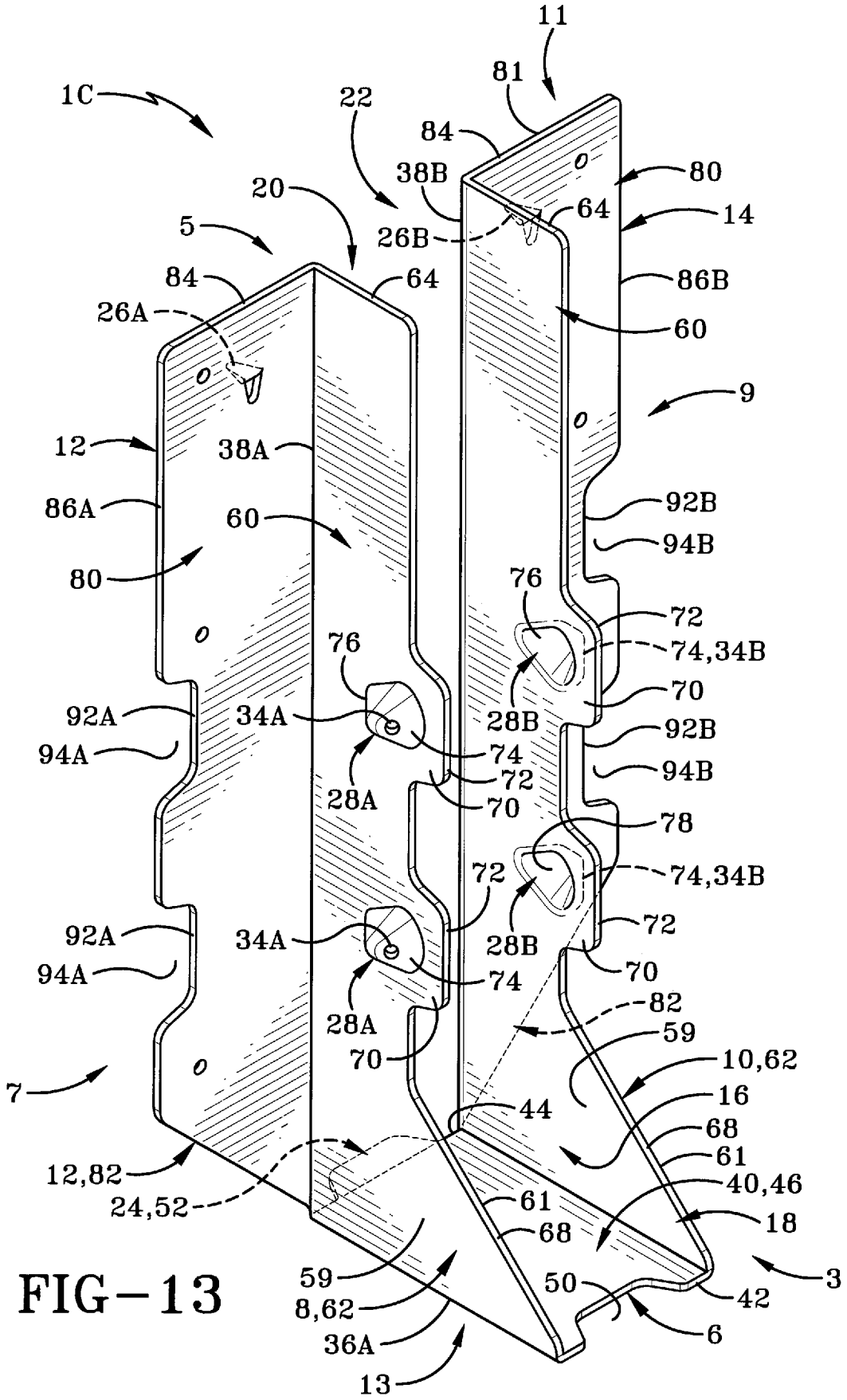
FIG. 13 is a perspective view of a fourth embodiment of the joist hanger of the present invention which is taller than the third embodiment and configured to accommodate an accordingly larger joist.

Several additional embodiments of the joist hanger of the present invention are shown in FIGS. 11-14. FIG. 11 shows a joist hanger 1A which is very similar to that of FIG. 1 with a few modifications. The height-setting break-off tab has a similar overall shape, but joist hanger 1A is formed without a slot 56 and legs 54 so that the tab is connected to the back of the bottom wall along a straight crimp that extends along the entire length of the intersection between the front of the tab and back end 44. FIG. 12 shows a joist hanger 1B which is taller than hangers 1 and 1A, and thus configured for use with a joist and/or header which is taller in the installed position. More particularly, the axial and longitudinal walls of joist hanger 1B are taller than those of hangers 1 and 1B, although the bottom wall has the same width. Joist hanger 1B also includes an additional set of domes 28. FIG. 13 shows a joist hanger 1C which is taller than hanger 1B and is thus configured for use with a taller joist and/or header. Joist hanger 1C includes two sets of domes 28 with the increase in height being above the upper set of domes 28.

Figure 14:
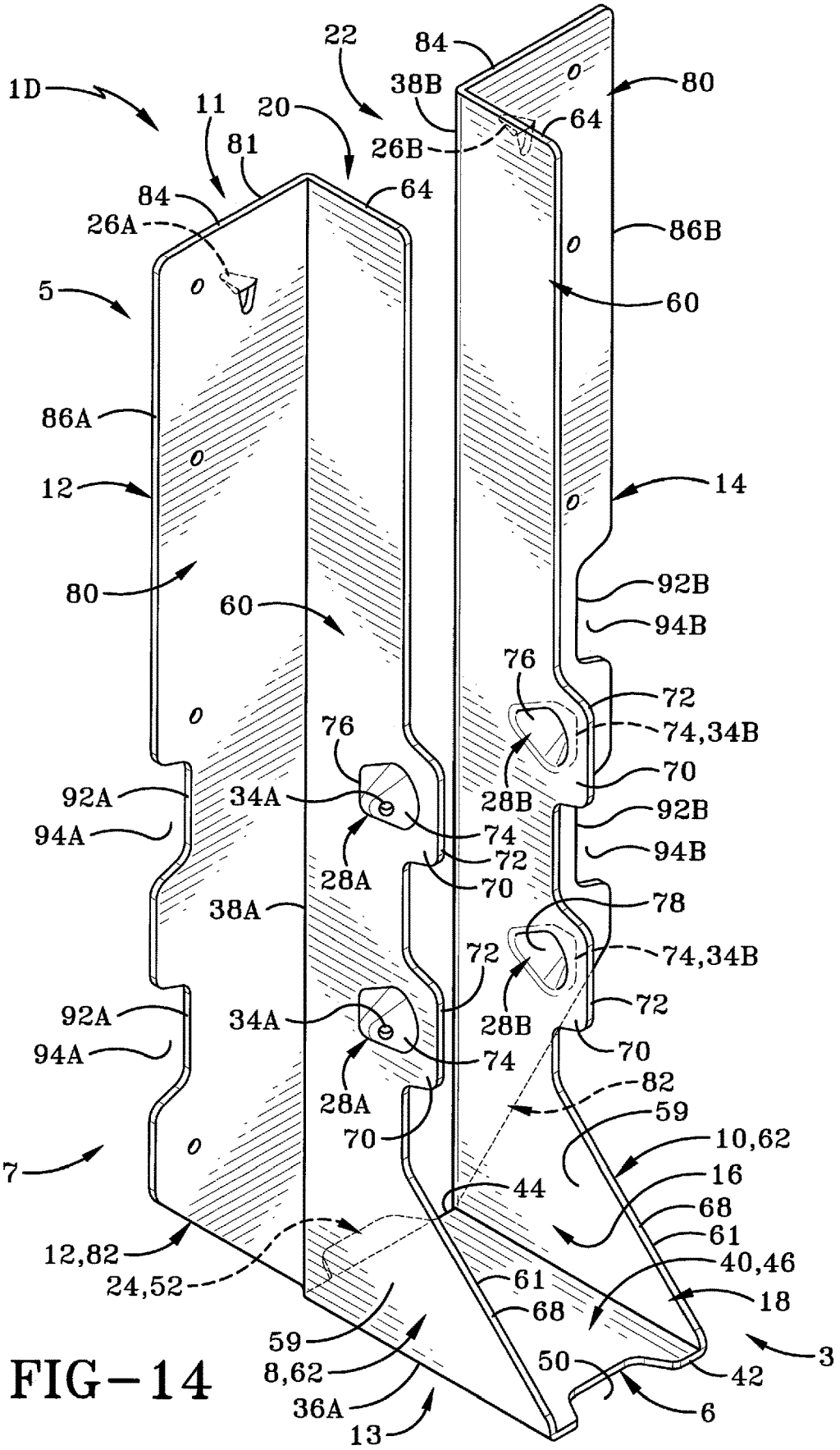
FIG. 14 is a perspective view of a fifth embodiment of the joist hanger of the present invention which is taller than fourth embodiment and configured to accommodate an accordingly larger joist.

FIG. 14 shows yet another joist hanger 1D which is taller than hanger 1C with the additional height likewise being above the upper set of domes 28. It will be understood by one skilled in the art that joist hangers 1A-1D are used in the same manner as described with respect to joist hanger 1 except that in the cases of joist hangers 1B-1C additional nails may be used with the additional nail holes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A combination of a joist hanger and a header having a bottom, the joist hanger comprising:

a joist support comprising a bottom wall, left and right axial joist-engaging walls which extend upwardly from adjacent the bottom wall and define therebetween a joist-receiving space, and a longitudinal wall having a header-engaging back surface which engages the header when the joist hanger is secured to the header;

a hole formed in the longitudinal wall; at least one tooth which is rigidly secured to the joist support, which extends rearwardly beyond the header-engaging back surface and that is adapted to be inserted into the header; and a substantially trapezoidal shaped height-setting tab having a pair of converging legs, wherein the height setting tab extends rearwardly from the joist support and attached thereto by the pair of converging legs, the converging legs define a fracture zone, the height-setting tab adapted to abut the bottom of the header to set a height of the joist hanger when the joist hanger is secured to the header solely by the at least one tooth, wherein the material of the fracture zone is thinner than the material adjacent thereto, wherein the longitudinal wall is a left longitudinal wall which is secured to and extends outwardly to the left of the left axial wall; the joist support comprises a right longitudinal wall which is secured to and extends outwardly to the right of the right axial wall; and a nail-receiving hole is formed in the right longitudinal wall;

a left hole formed in the left axial wall; and a right hole formed in the right axial wall, wherein the left axial wall comprises a flat left axial wall segment and a left dome which extends outwardly to the left from the left axial wall segment and which includes a front half and a back half;

the right axial wall comprises a flat right axial wall segment and a right dome which extends outwardly to the right from the right axial wall segment and which includes a front half and a back half;

the left hole is formed in the front half of the left dome; and the right hole is formed in the front half of the right dome, wherein the holes are vertically offset from each other.

2. The combination of claim 1 wherein the at least one tooth extends rearwardly beyond the header-engaging back surface to a tip; and the tip and header-engaging back surface define therebetween a horizontal length which is within a range of about 1/16 inch to about 3/16 inch.

3. The combination of claim 1 wherein the header has a vertical front surface and a horizontal top surface; the at least one tooth is inserted into the header through the vertical front surface; and no portion of the joist hanger extends directly above the horizontal top surface.

4. The combination of claim 1 wherein the joist hanger is free of a hanging wall which engages a top surface of the header when the joist hanger is mounted on the header.

5. The combination of claim 1 wherein the joist hanger is free of a built-in nail configured to be driven into the header by a tool.

6. The combination of claim 1 wherein the bottom wall and the tab have respective top surfaces which are coplanar.

7. The combination of claim 1 further comprising a break-off zone between the tab and the U-shaped support configured to facilitate breaking off the tab from the U-shaped support.

8. The combination of claim 1 wherein no portion of the joist hanger extends rearwardly beyond the header-engaging back surface other than the at least one tooth and the height-setting tab.

9. The combination of claim 1 in combination with a first nail extending through the hole formed in the left longitudinal wall; a second nail extending through the hole formed in the right longitudinal wall; a third nail extending through the left hole; and a fourth nail extending through the right hole.

10. The combination of claim 1 wherein the left longitudinal wall is secured to the left axial wall at a left vertical bend; and the right longitudinal wall is secured to the right axial wall at a right vertical bend.

11. The combination of claim 10 wherein the bottom wall is secured to the left axial wall at a left horizontal bend; and the bottom wall is secured to the right axial wall at a right horizontal bend.

12. The combination of claim 1 wherein the bottom wall is secured to the left axial wall at a left horizontal bend; and the bottom wall is secured to the right axial wall at a right horizontal bend.

13. A joist hanger comprising: a joist support having a bottom wall, left and right joist-engaging walls which extend upwardly from adjacent the bottom wall and define therebetween a joist-receiving space, and a longitudinal wall having a header-engaging back surface, which engages a header when the joist hanger is secured to the header;

at least one tooth having opposed planar surfaces, the at least one tooth extending from a portion of a hole edge that defines a hole disposed through the longitudinal wall to form a tooth edge, the tooth edge being positioned closer to a top edge of the longitudinal wall than any portion of the hole, and a substantially trapezoidal shaped height-setting tab having a pair of converging legs, wherein the height setting tab extends rearwardly from the joist support and attached thereto by the pair of converging legs, the converging legs define a fracture zone that is formed of material that is thinner than the material adjacent thereto;

wherein the at least one tooth extends at a substantially right angle from the header-engaging back surface so as to be securable to the header; and wherein a shape of the at least one tooth is the same as a shape of the hole;

wherein said right and left joist-engaging walls include respective right and left domes that extend outwardly therefrom, each said dome including a hole that are vertically offset from each other.

14. The joist hanger of claim 13 wherein the tip of the at least one tooth extends beyond the header-engaging back surface, such that the tip and the header-engaging back surface define therebetween a horizontal length which is within a range of about 1/16 inch to about 3/16 inch.

15. The joist hanger of claim 13 wherein no portion of the joist hanger extends rearwardly beyond the header-engaging back surface other than the at least one tooth.

16. The joist hanger of claim 13 in combination with the header, wherein the at least one tooth is inserted into the header so that the joist hanger is secured to the header solely by the at least one tooth.

17. The joist hanger of claim 13 further comprising a height-setting tab extending rearwardly from the joist support and adapted to abut a bottom of the header to set a height of the joist hanger when the joist hanger is secured to the header.

18. The joist hanger of claim 13 wherein the longitudinal wall is a left longitudinal wall, which is secured to and extends outwardly to the left of the left joist-engaging wall, and the joist support includes a right longitudinal wall, which is secured to and extends outwardly to the right of the right joist-engaging wall;

wherein a hole is formed in the right longitudinal wall.

* * * * *